United States Patent [19]

Cottam

[11] Patent Number: 4,783,875

[45] Date of Patent: Nov. 15, 1988

[54] CLEANING DEVICE

[76] Inventor: Spencer D. Cottam, 11210 Cypress Way Dr., Houston, Tex. 77054

[21] Appl. No.: 15,139

[22] PCT Filed: Jun. 10, 1985

[86] PCT No.: PCT/US85/01076

§ 371 Date: Feb. 10, 1987

§ 102(e) Date: Feb. 10, 1987

[87] PCT Pub. No.: WO86/07292

PCT Pub. Date: Dec. 18, 1986

Related U.S. Application Data

[63] Continuation-in-part of Ser. No. 513,695, Jul. 14, 1983, Pat. No. 4,531,253.

[51] Int. Cl.[4] ..... A47L 13/08

[52] U.S. Cl. ..... 15/236.01; 15/93 R; 30/172; 30/350

[58] Field of Search ..... 15/93 R, 236; 51/177; 29/81 J, 81 G; 299/41, 89; 30/172, 477, 350; 144/118

[56] References Cited

U.S. PATENT DOCUMENTS

| | | | |
|---|---|---|---|
| 1,607,083 | 11/1926 | Ignatieff | 30/350 |
| 1,786,096 | 12/1930 | Thielmann | 15/93 R |
| 2,480,739 | 8/1949 | Johnson | 15/93 R |
| 2,504,643 | 4/1950 | Burgoon | 15/93 R |
| 2,565,047 | 8/1951 | Rowland | 15/93 R |
| 3,049,739 | 8/1962 | Lantto | 30/172 |
| 3,722,022 | 3/1973 | Falleson | 15/236 R |
| 3,958,294 | 5/1976 | Thompson | 15/93 R |
| 4,106,193 | 8/1978 | Fisher et al. | 15/93 R |
| 4,148,110 | 4/1979 | Moen | 15/236 R |
| 4,385,412 | 5/1983 | Neufeldt | 15/93 R |

FOREIGN PATENT DOCUMENTS

| | | | |
|---|---|---|---|
| 1041386 | 10/1958 | Fed. Rep. of Germany | 15/93 R |
| 1120688 | 4/1956 | France . | |
| 0312704 | 11/1933 | Italy | 15/93 R |

*Primary Examiner*—Edward L. Roberts .

*Attorney, Agent, or Firm*—Pravel, Gambrell, Hewitt, Kimball & Krieger

[57] ABSTRACT

A cleaning apparatus for contacting a surface to be cleaned comprising a plurality of bent wires (10) mounted with a resilient mounting member (11) and adapted to be moved to a cutting position when the mounting member (11) is rotated or otherwise moved relative to the surface to be cleaned.

20 Claims, 4 Drawing Sheets

CLEANING DEVICE

This patent application is a continuation-in-part of U.S. patent application Ser. No. 513,695, filed July 14, 1983, which issued as U.S. Pat. No. 4,531,253 on July 30, 1985.

FIELD OF THE INVENTION

The field of this invention relates generally to cleaning devices for contacting a surface to be cleaned.

BACKGROUND OF THE INVENTION

It is known in the field of carding devices to utilize wire clips mounted in closely set rows in various belting materials fastened to the back for carding fibers. However, such carding devices are not used in grinding or contacting a surface to remove rust, paint, etc. Further the wires in such carding devices do not include the use of a wear resistant coating.

Wire brushes are presently used to abrade a surface. Generally, such wire brushes have a plurality of wires mounted with a rigid frame and the wires mounted therein are designed to flex in response to the abrasive action between the surface and the wire brush such that the wire drags across the surface to be cleaned.

SUMMARY OF THE INVENTION

The cleaning device of the present invention includes a plurality of bent wires mounted in a resilient member. The resilient member may be further adapted for connection with a drive unit to drive both the resilient member and the bent wires relative to a surface to be cleaned. During such movement the engagement of the bent wires with the surface to be cleaned causes the leading edge of each bent wire to be directed toward the direction of movement of the mounting member.

In the present invention, fatigue failures of the wires are reduced because the resilient member permits a pivoting type movement of the bent wires in the resilient mounting member. As such, a stiffer wire can be utilized to effect more rapid cleaning of a surface. Moreover, the wire retains an angle with respect to the direction of abrasion such that the wire contacts the surface in a cutting configuration which lifts or chips and not in a trailing configuration unlike wire brushes where the cutting action is obtained by dragging the wire across the surface to be cleaned.

DESCRIPTION OF THE PREFERRED EMBODIMENT

Figure 1:
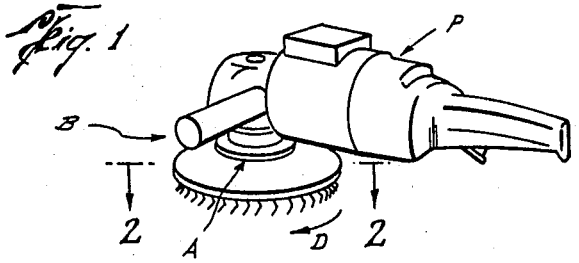
FIG. 1 is a perspective view of the cleaning device mounted with a rotary drive unit.

In FIGS. 1–12, the cleaning device of the present invention is generally designated by the letter B. The cleaning device B includes a plurality of bent wires mounted in a resilient mounting member.

Each of the bent wires has a crown portion 12 and a pair of elongated pins 14 integrally attached thereto extending substantially perpendicular in a downward direction from the crown portion 12. In a first embodiment of the bent wires 10 shown in FIGS. 3 and 4, the crown portion 12 is mounted on the upper surface of resilient mounting member 11 and the elongated pins 14 extend downwardly through the resilient mounting member 11. Each of the elongated pins 14 has a first portion 16 which is angularly disposed within the resilient mounting member 11 in a rearward direction with respect to the direction of rotation or movement of the mounting member 11. The inclined first portion 16 preferably makes an angle d, with a perpendicular drawn to the surface of resilient member 11. The angle d is preferably about 30°. Integrally attached with the first portion 16 is a second portion 18 which is formed relative to the first portion 16 such that it makes an angle b with a perpendicular drawn to the surface of resilient mounting member 11. The second angle b is preferably about 30°.

As will be discussed more in detail later, the direction of movement for the cleaning device B is shown by the arrow D. Relative to the direction of arrow D, the first portion 16 is mounted in a substantially trailing direction or away from the direction of rotation of mounting member 11. The second portion 18 is deformed in a leading direction or towards the direction of rotation of the mounting member 11.

Figure 6:
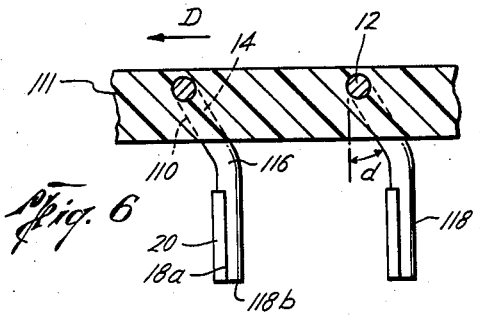
FIG. 6 is a view, partly in section, of the cleaning device looking along line 3—3 in FIG. 2 showing a third embodiment of two of the bent wires prior to contact with a surface to be cleaned.

FIG. 6 shows an alternate embodiment of the bent wires 110 which include an inclined first portion 116 preferably making an angle d with a perpendicular drawn to the surface of resilient member 111. The angle d is preferably about 30°. Integrally attached with the first portion 116 is a second portion 118 which is formed relative to the first portion 116 such that it is substantially perpendicular to the surface of resilient member 111. This orientation of the second portion 118 facilitates sharpening of the bent wire 110 when not in use.

Each of the bent wires 10, 110, 10' and 110' (described below) preferably includes a wear resistant material 20 which, may be a coating fixed to the leading edge **18*a* of the second portion 18 and 118 of the bent wire or may be a tip of such material brazed or welded on the second portion 18 and 118. Such wear resistant material 20** is preferably tungsten carbide, although those skilled in the art will appreciate that other wear resistant coatings can be used.

Figure 3:
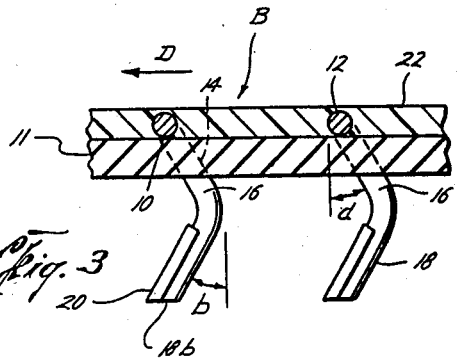
FIG. 3 is a view, partly in section, of the cleaning device looking along line 3—3 in FIG. 2 showing one embodiment of two of the bent wires prior to contact with a surface to be cleaned.
Figure 4:
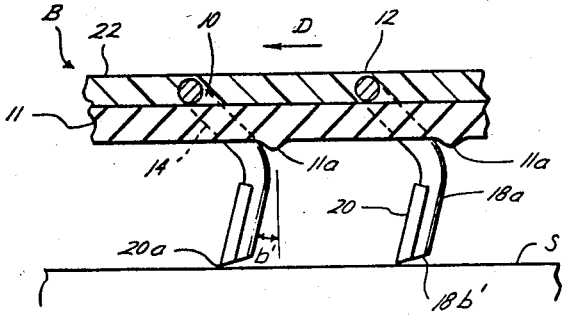
FIG. 4 is a view, partly in section, of the apparatus in FIG. 3 showing the displacement of the wires during contact with a surface to be cleaned.
Figure 5:
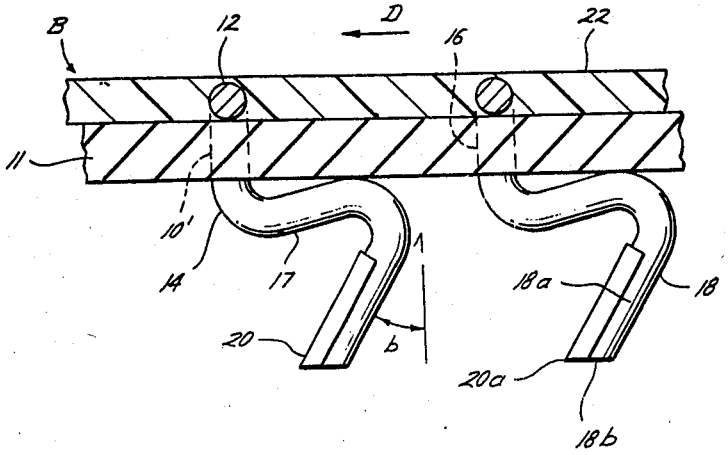
FIG. 5 is a partially sectional view of the cleaning device looking along line 3—3 of FIG. 2 showing a second embodiment of the bent wires.
Figure 7:
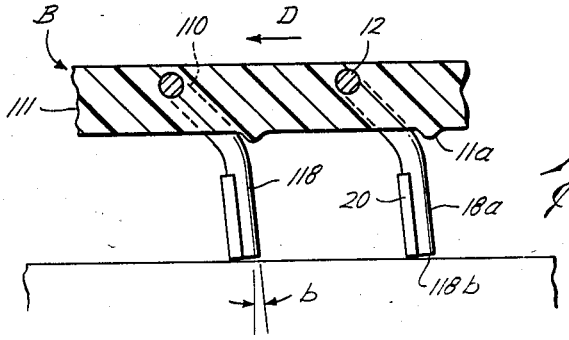
FIG. 7 is a view, partly in section, of the apparatus in FIG. 6 showing the displacement of the wires during contact with the surface to be cleaned.
Figure 8:
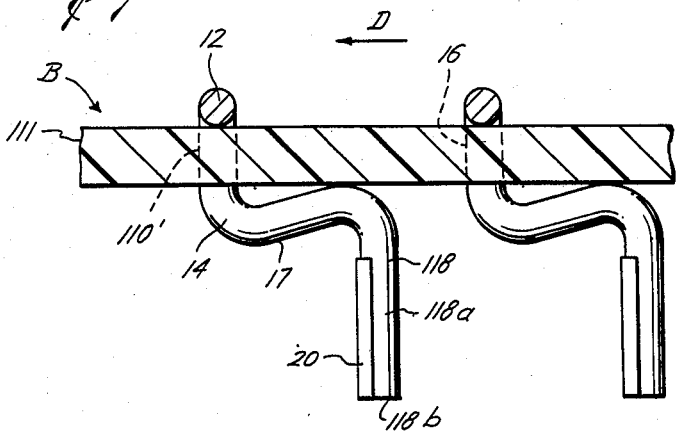
FIG. 8 is a view, partly in section, of the cleaning device looking along line 3—3 of FIG. 2 showing a fourth embodiment of the bent wires.
Figure 9:
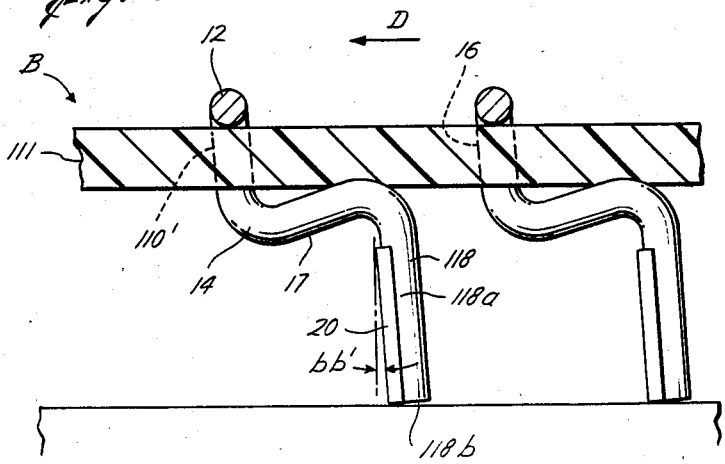
FIG. 9 is a view, partly in section, of the apparatus in FIG. 8 showing the displacement of the wires during contact with the surface to be cleaned.

With the bent wires 10 mounted in resilient mounting member 11, a resilient material 22 is bonded by any suitable means or is otherwise attached to the resilient member 11 with the crown portion 12 of each bent wire 10 embedded therein (FIGS. 3–5). Such resilient material 22 cooperates with resilient mounting member 11 in keeping the bent wires 10 attached to the resilient member 11. The resilient coating 22 is preferably a layer of rubber material bonded to the bent wires 10 and the resilient mounting member 11. As an alternative, bent wires 110 can be embedded in a single layer of resilient material 111 as shown in FIGS. 6 and 7, or oriented through holes in the resilient material 111 as shown in FIGS. 8 and 9.

Figure 2:
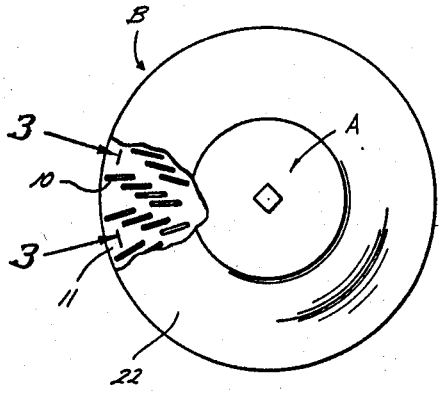
FIG. 2 is a partially cut away plan view of the cleaning device looking along lines 2—2 in FIG. 1.
Figure 10:
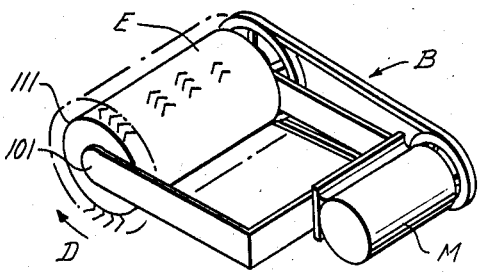
FIG. 10 is a perspective view of an alternate embodiment of the cleaning device of the present invention.
Figure 11:
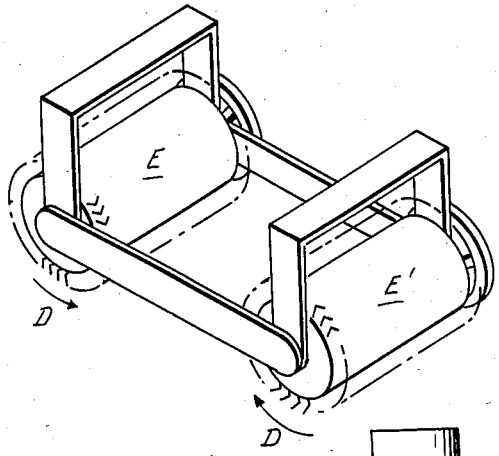
FIG. 11 is a perspective view of an alternate embodiment of the cleaning device.
Figure 12:
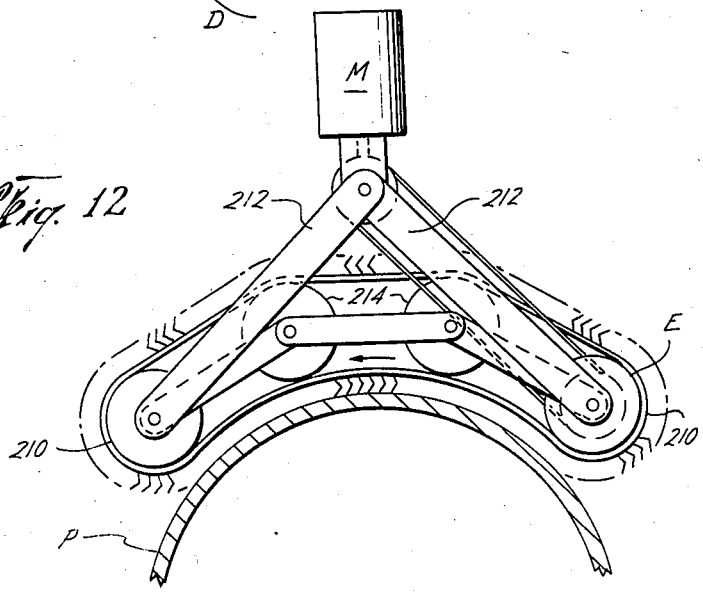
FIG. 12 is a perspective view of an alternate embodiment of the cleaning device of the present invention.

In the embodiments shown in FIGS. 3–9, the cleaning device B can be adapted for mounting with conventional rotating power tools. For example, as shown in FIGS. 1 and 2, the cleaning device B includes a conventional mounting means A for releasably connecting the cleaning device B to a rotary power tool P. As shown in FIGS. 10–12, the cleaning device can be easily adapted to alternate power drive means.

The resilient mounting member 11 shown in FIGS. 1 and 2 is preferably in the form of a rubber disc with wire or other reinforcements. Alternative embodiments of the cleaning device B are also comprehended and could include a cleaning device in which the resilient mounting member 111 is a drum (FIGS. 10 and 11) or an endless belt (FIG. 12) either of which is suitable for movement with a conventional power drive unit M. FIG. 10 shows a cleaning device B driving by power drive unit M in which the resilient mounting member 111 is a Drum E. Drum E can be a section of reinforced hose including end supports. Drum E can include interior supports (not shown) such as resilient discs mounted on axle 101 or a resilient filler such as a foam material. As an alternative Drum E may be inflatable or include an inflatable liner to allow the resilience to be varied by varying the air pressure. The drum shape is able to conform to irregular or non-planar shapes while providing even contact along the length of the drum.

FIG. 11 shows an alternate embodiment of FIG. 10 wherein two counter rotating drums E and E′ are employed. The embodiment of FIG. 11 is able to provide cleaning action to both sides of a bump such as a weld or in a pit or groove without reorienting the drum for a second pass due to the countr rotation of drums E and E′.

FIG. 12 shows an alternate embodiment in which an endless belt E is supported by end rollers 210 and support rollers 214. The belt E is driven by a drive belt or chain from the power unit M. This embodiment allows curved surfaces such as pipe P to be cleaned.

Looking at FIG. 4, the cleaning device B of the present invention is shown during contact with the surface S for the purpose of cleaning the surface by removing rust, paint or the like from such surface S. As the cleaning device B rotates in the direction shown by arrow D and bent wires 10 contact surface S, a bending moment is generated tending to pivot the bent wires 10 from the position shown in FIG. 3 to that shown in FIG. 4. Such rotation or pivoting is possible because resilient member 11 permits bent wires 10 to pivot in response to the bending moment without any significant flexing of the bent wires 10. Responsive to the rotation of bent wires 10, resilient mounting member 11 flexes to form bulge **11*a* and thereby resists further rearward pivoting of bent wires 10. As bent wire 10 rotates, a downward vector acts upon the crown portion 12 to force it into the resilient mounting member 11 so as to retain the bent wire 10 from being pushed upwardly and out of the resilient mounting member 11**.

During cleaning, bent wires 10 move from the position shown in FIG. 3 (angle b) to the position shown in FIG. 4 (angle b′). Angle b′ is about 15° and allows the bent wires 10 to cut like a knife or machine tool rather than drag like a wire brush across the surface S. From the position shown in FIG. 6, the bent wires 110 move to the position shown in FIG. 7 (angle bb). Angle bb is from about 3° to about 15° and allows the bent wires 110 to cut underneath a coating or corrosion scale to lift or chip upwardly for removal.

Since the bent wires 10 and 110 do not bend or flex appreciably when they contact the work surface S, failures due to fatigue and breakage caused by repeated flexing of the bent wires 10 and 110, as would be encountered with a common wire brush, are eliminated. As such, stronger, stiffer wires 10 and 110 can be used since most of the flexing occurs within the resilient means 11 and 111 and not the bent wires themselves.

The thin layer or surface of tungsten carbide 20 placed on the leading edge **18*a* of each of the wires 10 and 110 provides a wear resistant cutting edge 20*a*. The bent wires 10 are generally made of spring steel and are less wear resistant than the coating 20. Hence lower surface 18*b* of bent wires 10 is constantly worn away when it engages surface S so as to continually provide a sharp cutting edge 20*a*. Cutting edge 20*a* is thus self sharpening due to the differential wear between the tungsten carbide coating 20 and bent wire 10. The bent wires 110 include a flat lower surface 118*b* which allows sharpening of the bent wires by moving a stone across the flat lower surface 118*b* using a bearing pressure light enough so that the bent wires 110 do not rotate in response to the bending movement generated by the relative motion shown by arrow D, thus enabling the flat lower surface of bent wires 118*b*** of the cleaning device to be sharpened. The sharpening can take place during cleaning operations or as a separate action.

Depending upon the surface finish desired on the surface S, various gauges of bent wires 10 and 110 can be used. For example, smaller diameter bent wires 10 and 110 can be utilized to achieve a finer finish or higher degree of polish. By altering the angles b and d of the bent wires 10 and angles d and bb of bent wires 110 or the stiffness of resilient mounting member 11 and 111, a textured surface pattern can be imparted to surface S which is desirable for good paint adhesion. The preferred material for bent wires 10 and 110 is a spring steel wire about three millimeters in diameter and having a second portion 18 and 118 length of from about 2 to about 2.5 centimeters.

The surface finish provided by the cleaning device of the present invention can be varied by altering the tip speed of the moving bent wires, the flexibility of the resilient mounting member and the contact pressure. When operated at a tip speed of about 240 meters per minute the cleaned surface has the appearance of a sand blasted surface. However, because the cleaning action is a lifting, chipping action the surface is more resistant to flash corrosion, is free of contaminants such as embedded sand or grit and has a better anchor pattern than a sand blasted surface. Sand blasting results in the embedding of sand or dust particles in the surface as well as the creation of a surface which on an enlarged scale (at 1000 times enlargement) has the appearance of many peaks and valleys. Such a surface structure is very susceptible to flash rusting and entrapment of gasses in pockets by a subsequently applied coating, which conditions are avoided by the use of the present apparatus.

The cleaned surface provided by the present invention is free of embedded contaminants and on an enlarged scale (at 1000 times enlargement) has the appearance of mesas, that is large flat areas with boundary ridges which are believed to be the metal crystal boundary layers. Such a surface has been found to be highly resistant to flash corrosion due to the elimination of cracks and fissures which entrap moisture and is a more effective anchor pattern for paint or other surface coatings than provided by the prior art.

In use, the cleaning device B is operated to remove rust, paint as well as other undesirable surface conditions. As the cleaning device B moves the bent wires 10 relative to the surface S, the flat end surface **18*b* resistively engages the surface S. Because of the resistive engagement of surfaces S, the bending movement tends to rotate the bent wire 10 from angle b to angle b' and a portion of the lower end surface 18*b* is worn away to form an angled lower surface 18*b*', as seen in FIG. 4, so as to provide a self-sharpening cutting edge 20*a*. As bent wires 110 engage the surface S, the bent wires 110 tend to rotate from the substantially perpendicular orientation to angle bb. The substantially perpendicular orientation of second portion 118 when not in use allows the sharpening of flat end surface 118*b* with a flat stone. Further such an alignment of leading edge 118*a*** provides a cutting action which lifts or chips upwardly by cutting underneath the coating or corrosion to be removed. The preferred operating speed is about 240 meters per minute tip speed which produces a surface that has the appearance of a sand blasted surface. Higher speeds may be employed for a high coating removal rate. In addition to rotation of drum E, drum E can also be oscillated along its axis in order to produce a more random cutting or chipping and thus eliminate grooving of the surface to be cleaned by successive cutting or chipping of the bent wires as the bent wires pass over the surface.

The tip speed, the bent wire diameter, the configuration of the bent wires and mounting of the bent wires in the resilient mounting means can be adjusted such that a natural vibration frequency is established which controls chatter of the bent wire on the surface to provide a desirable surface appearance.

A second embodiment of the bent wires 10' is shown in FIG. 5. The first portion 16 of pin 14 is mounted substantially upright in the resilient member 11 such that angle d is 0°. The elongated pins 14 include a substantially horizontal interconnecting portion 17 integrally formed between the first portion 16 and the second portion 18. The interconnecting portion 17 is positioned substantially parallel to the surface of resilient mounting member 11. The second portion 18 is deformed relative to the interconnecting portion 17 and is at an angle b relative to the resilient mounting member 11.

The second embodiment of bent wire 10' rotates in substantially the same manner as the first embodiment of bent wire 10 in response to the bending movement generated by the relative motion shown by arrow D. However, in response to an upward vertical force on bent wire 10', substantially all of such force is translated into a rotating or pivoting movement on bent wire 10' tending to draw the crown portion 12 further into resilient mounting member 11 and compress interconnecting portion 17 into resilient mounting member 11. As such, the ejection of the bent wires 10' out of resilient mounting member 11 due to a vertically upward force is substantially eliminated.

A fourth embodiment of the bent wires 110' is shown in FIGS. 8 and 9. In the fourth embodiment the first portion 16 of pin 14 is mounted substantially upright and includes a substantially horizontal interconnecting portion 17 as discussed above with respect to the second embodiment. The second portion 118 extends substantially perpendicular to resilient member 11 (FIG. 8) and upon engagement with the surfaces rotates to an angle bb' of from about 3° to about 15° (FIG. 9). Upon contact of bent wire 110' with the surface to be cleaned, the bent wire 110' rotates in response to the bending movement generated by the relative motion shown by arrow D. However, in response to an upward vertical force on bent wire 110', substantially all of such force is translated into a rotating or pivoting movement on bent wire 110' tending to draw the crown portion 12 into resilient mounting member 11. The substantially perpendicular orientation of second portion 118 which results in angle bb' upon engagement with the surface provides the chipping and lifting cutting action of the present invention.

FIG. 12 shows an endless belt E arrangement which could be used to clean rust or paint coatings from curved surfaces such as pipe P. The endless belt E is mounted on end pulleys or drums 210 at least one of which is driven by a belt or chain (not shown) connected to a drive motor M. Drive motor M is mounted to drums 210 by support legs 212. Oriented between drums 210 are support wheels 215 which provide support for endless belt E which is of such a length so as to be able to conform to the contour of pipe P.

The bent wires can be coated with an adhesion reducing material such as polytetrafluoroethylene, polyethylene or any other suitable material to reduce the gumming and sticking of tacky substances to the bent wires during the removal of such substances by the apparatus of the present invention.

In the drawings, like reference numbers refer to corresponding elements.

The foregoing disclosure and description of the invention are illustrative and explanatory thereof, and various changes in the size, shape and materials, as well as in the details of the illustrated construction may be made without departing from the spirit of the invention.

I claim:

1. A cleaning device for use with a drive unit for contacting a surface to be cleaned comprising:

a plurality of bent wires, each wire having a crown portion and a pair of elongated pins extending substantially perpendicular in a downward direction from said crown portion;

a resilient mounting member receiving each of said bent wires with the crown portion on the upper surface of said member and with said elongated pins extending through said resilient mounting member;

said elongated pins having a first portion angularly disposed to the surface plane of said resilient mounting member and substantially within said resilient mounting member and a second portion connected to the first portion at an opposite angle relative to said first portion;

means cooperating with said mounting member for releasably attaching said device to a drive unit to impart movement to said wires relative to the surface to be cleaned; and said bent wires having an adhesion resistant coating.

2. A cleaning device for use with a drive unit for contacting a surface to be cleaned comprising:

a plurality of bent wires, each wire having a crown portion and a piar of elongated pins extending substantially perpendicular in a downward direction from said crown portion;

a resilient mounting member receiving each of said bent wires with the crown portion imbedded in said member and with said elongated pins extending through a portion of said resilient mounting member; and said elongated pins having a first portion angularly disposed to the surface plane of said resilient mounting member and substantially within said resilient mounting member and a second portion connected to the first portion at an angle substantially perpendicular relative to said resilient mounting member; and means cooperating with said mounting member for releasably attaching said device to a drive unit to impart movement to said wires relative to the surface to be cleaned, whereby, upon movement of said device in a predetermined direction, impact between said second portion and said surface to be cleaned is caused, and said resilient mounting member exerts a downward force on said first portion, causing a reaction force to be exerted on each of said crown portions in a direction towards and substantially perpendicular to the surface to be cleaned.

3. The cleaning device of claim 2, further including:

a wear resistant coating being fixed on the second portion of said elongated pins.

4. The cleaning device of claim 2, wherein:

the first portion of said elongated pins being angled away from the direction of movement of the resilient mounting member when it is driven by a drive unit.

5. The cleaning device of claim 2, wherein said elongated pins include:

an intermediate portion connecting said first portion and said second portion, said intermediate portion being positioned substantially parallel with said resilient mounting means.

6. The cleaning device of claim 2, wherein:

said resilient mounting member is a disc adapted for rotary movement.

7. The cleaning device of claim 2, wherein:

said resilient mounting member comprises a cylindrical shape having said bent wires extending therefrom.

8. The cleaning device of claim 2, wherein:

said resilient mounting member comprises a pair of counter rotating drums.

9. The cleaning device of claim 2, wherein:

said resilient mounting member comprises an endless belt driven by supporting cylinders and including an idler cylinder to support said belt whereby curved surfaces such as pipe may be cleaned.

10. The cleaning device of claim 2, wherein:

said bent wires include an adhesion resistant coating.

11. A cleaning device for use with a drive unit for contacting a surface to be cleaned comprising:

a plurality of bent wires, each wire having a crown portion and a pair of elongated pins extending substantially perpendicular in a downward direction from said crown portion;

a resilient mounting member receiving each of said bent wires with the crown portion embedded within said member and with said elongated pins extending through a portion of the resilient mounting member;

said elongated pins having a first portion disposed substantially within said resilient mounting member in a substantially perpendicular direction from said mounting member, an intermediate portion connected to said first portion and positioned substantially parallel with said resilient mounting member, and a second portion connected to the intermediate portion at an angle relative to said first portion and substantially perpendicular relative to said mounting member, whereupon impact between said second portion and the surface to be cleaned, said intermediate portion contacts said resilient mounting member whereupon said resilient mounting member exerts a downward force independently on each said intermediate portion in a direction substantially perpendicular to the surface to be cleaned; and means with said mounting member for releasably attaching to a drive unit to impart movement to said wires relative to the surface to be cleaned.

12. The cleaning device of claim 11, wherein:

said first portion of said elongated pins is at a slight angle to the surface of said resilient mounting member and substantially within said resilient mounting member.

13. The cleaning device of claim 11, wherein:

said resilient mounting member is a disc adapted for rotary movement.

14. The cleaning device of claim 11, wherein:

said resilient mounting member comprises a cylindrical shape having said bent wires extending therefrom.

15. The cleaning device of claim 11, wherein:

said resilient mounting member comprises a pair of counter rotating drums.

16. The cleanin device of claim 11, wherein:

said resilient mounting member comprises an endless belt driven by supporting drive cylinders and including at least one idler cylinder between said drive cylinders to support said belt whereby curved surfaces such as pipe may be cleaned.

17. The cleaning device of claim 11, wherein:

said bent wires include an adhesive resistant coating.

18. A method for cleaning a coating from a surface which comprises contacting a surface to be cleaned with a plurality of bent wires, each wire having a crown portion and a pair of elongated pins extending substantially perpendicular in a downward direction from said crown portion with said crown portion embedded in a resilient mounting member such that said elongated pins extend therefrom at an angle so as to cut under the coating to be cleaned and remove the coating by upwardly chipping away the coating when driven by a drive unit.

19. The method of claim 18, wherein said elongated pin include a wear resistant coating fixed on a portion of said elongated pins which contacts said surface to be cleaned.

20. The method of claim 18, wherein:

said elongated pins include an adhesion resistant coating.

* * * * *